US006974270B2

(12) United States Patent
Cockerill et al.

(10) Patent No.: US 6,974,270 B2
(45) **Date of Patent: *Dec. 13, 2005**

(54) TAPE PRINTING DEVICE

(75) Inventors: Sam Cockerill, Cambridge (GB); Costa Panayi, Hertfordshire (GB); Francois Lecomte, Woking (GB); Anthony Roy Dunn, Hertfordshire (GB); Jonathan Tremlett, London (GB)

(73) Assignee: Esselte, Sint Niklaas (BE)

( * ) Notice: Subject to any disclaimer, the term of this patent is extended or adjusted under 35 U.S.C. 154(b) by 0 days.

This patent is subject to a terminal disclaimer.

(21) Appl. No.: 10/854,641

(22) Filed: May 27, 2004

(65) Prior Publication Data

US 2004/0218957 A1 Nov. 4, 2004

Related U.S. Application Data

(60) Continuation of application No. 10/202,009, filed on Jul. 25, 2002, now abandoned, which is a division of application No. 09/138,743, filed on Aug. 24, 1998, now Pat. No. 6,503,005.

(30) Foreign Application Priority Data

Aug. 22, 1997 (GB) ..... 9717933
Apr. 21, 1998 (GB) ..... 9808445

(51) Int. Cl.[7] ..... B41J 3/39; B41J 11/70
(52) U.S. Cl. ..... 400/88; 400/613; 400/621; 400/693
(58) Field of Search ..... 400/88, 613, 621, 400/691, 693; 101/288

(56) References Cited

U.S. PATENT DOCUMENTS 3,823,808 A 7/1974 Murata et al. ..... 400/613
4,177,104 A 12/1979 Parker ..... 156/584
4,636,593 A 1/1987 Novak et al. ..... 200/5
4,734,710 A 3/1988 Sato et al. ..... 400/611
4,734,713 A 3/1988 Sato et al. ..... 400/611
4,830,525 A 5/1989 Nagashima et al. ..... 400/472
4,871,269 A 10/1989 Murata ..... 400/88
5,015,324 A 5/1991 Goodwin et al. ..... 101/288
5,021,984 A 6/1991 Meade et al. ..... 708/146
5,160,943 A 11/1992 Pettigrew et al. ..... 400/120
5,181,787 A 1/1993 Hosomi ..... 400/120
5,222,818 A 6/1993 Akiyama et al. ..... 400/61
5,294,782 A 3/1994 Kumar ..... 235/380
5,318,370 A 6/1994 Nehowig ..... 400/613
5,344,248 A 9/1994 Schoon et al. ..... 400/693

(Continued)

FOREIGN PATENT DOCUMENTS

DE 7503879 8/1976

(Continued)

*Primary Examiner*—Daniel J. Colilla
(74) *Attorney, Agent, or Firm*—Morgan, Lewis&Bockius LLP

(57) ABSTRACT

The invention refers to a tape printing device (2) for hand-held operation, having a housing with a first part and a second part, wherein the first part of the housing comprises a surface with a keyboard with keys (6) for inputting desired characters to be printed onto an image receiving tape (80), the surface having a breadth which is larger than a thickness of the first part of the housing, preferably a multiple thereof, and the second part of the housing comprises a cassette receiving bay (54) for accomodating a tape cassette (100) holding a supply of the image receiving tape (80), the second part of the housing further enclosing a print mechanism (26) arranged to print the desired characters onto the image receiving tape (80).

Further a tape cassette (100) with an angled peel slot (110) is disclosed.

27 Claims, 13 Drawing Sheets

U.S. PATENT DOCUMENTS

| | | | | |
|---|---|---|---|---|
| 5,358,351 | A | 10/1994 | Murata et al. | 400/605 |
| 5,374,132 | A | 12/1994 | Kimura | 400/586 |
| 5,411,339 | A | 5/1995 | Bahrabadi et al. | 400/56 |
| 5,435,657 | A | 7/1995 | Pearce et al. | 400/208 |
| 5,626,428 | A | 5/1997 | Miwa | 400/486 |
| 5,661,634 | A * | 8/1997 | Obata et al. | 361/684 |
| 5,741,082 | A | 4/1998 | Toya | 400/615.2 |
| 5,879,505 | A | 3/1999 | Fujisawa et al. | 156/344 |
| 5,980,133 | A | 11/1999 | Nunokawa et al. | 400/61 |
| 6,435,744 | B1 | 8/2002 | Dunn et al. | 400/621 |

FOREIGN PATENT DOCUMENTS

| | | | | |
|---|---|---|---|---|
| DE | 836163 | | 4/1995 | |
| EP | 0 191 495 | A2 | 8/1986 | |
| EP | 0250910 | A2 | 1/1988 | |
| EP | 267890 | | 5/1988 | |
| EP | 0322918 | A2 | 7/1989 | |
| EP | 322919 | | 7/1989 | |
| EP | 325515 | A | 7/1989 | |
| EP | 0526213 | | 2/1993 | |
| EP | 578372 | | 1/1994 | |
| EP | 0607025 | | 7/1994 | |
| EP | 0634273 | | 1/1995 | |
| EP | 0734878 | | 10/1996 | |
| EP | 0 798 121 | A2 | 10/1997 | |
| EP | 0 634 276 | A2 | 1/1998 | |
| GB | 2 318 094 | | 4/1998 | |
| GB | 2 318 094 | A | 4/1998 | |
| JP | 61-185469 | | 8/1986 | |
| JP | 1-64460 | | 4/1989 | |
| JP | 2-235669 | | 9/1990 | |
| JP | 3-23456 | | 3/1991 | |
| JP | 7-0501903 | | 2/1995 | |
| JP | 8-11361 | | 1/1996 | |
| JP | 8-147331 | | 6/1996 | |
| JP | 08169155 | A * | 7/1996 | B41J 19/18 |
| JP | 08276626 | A * | 10/1996 | B41J 13/00 |
| JP | 09123433 | A * | 5/1997 | B41J 02/01 |
| WO | WO 95/15855 | | 6/1995 | |

* cited by examiner

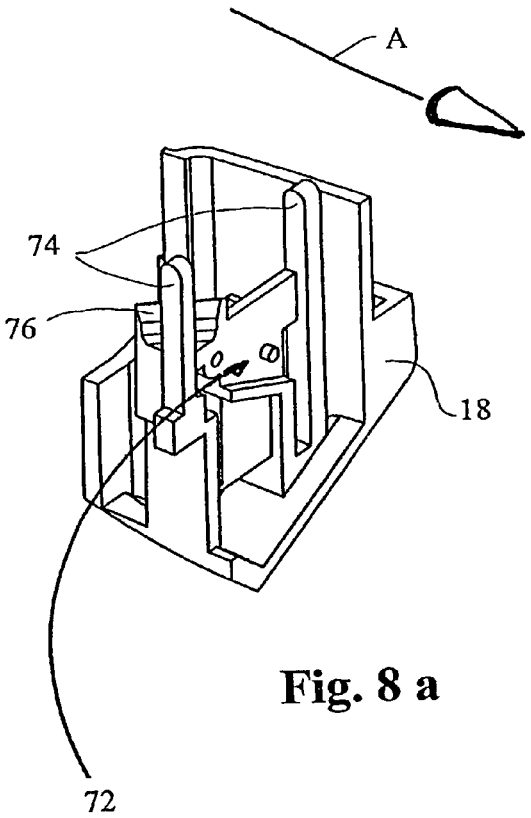
Fig. 8 a
Fig. 8 b
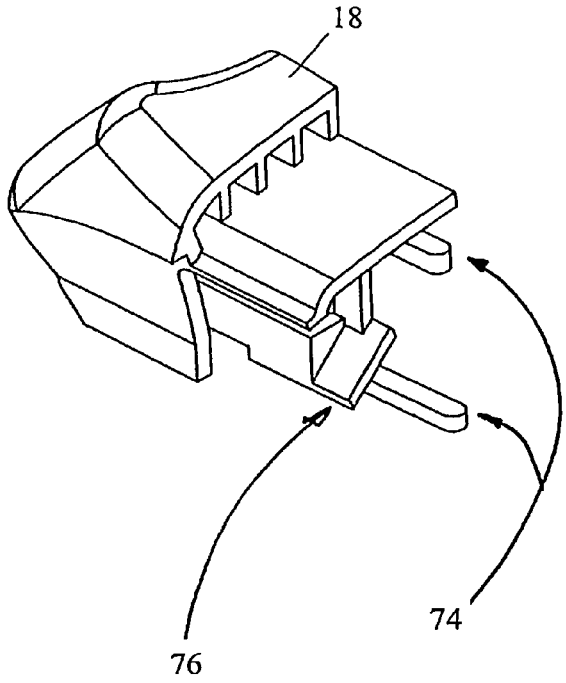
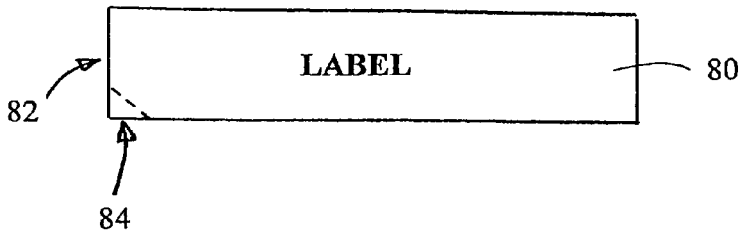
Fig. 10

TAPE PRINTING DEVICE

CROSS REFERENCE TO RELATED APPLICATIONS

This application is a continuation of U.S. Ser. No. 10/202,009, filed Jul. 25, 2002 Now Abandoned, which is a divisional of application Ser. No. 09/138,743, filed Aug. 24, 1998, now U.S. Pat. No. 6,503,005.

BACKGROUND OF THE INVENTION

The present invention relates to a tape printing device.

Known tape printing apparatus of the type with which the present invention is generally concerned are disclosed in EP-A-322918 and EP-A-322919 (Brother Kogyo Kabushiki Kaisha) and EP-A-267890 (Varitronics). These tape printing apparatus each include a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double-sided adhesive tape which is secured at one of its adhesive coated sides to the image receiving tape after printing and which has a backing layer peelable from its other adhesive coated side. With both these apparatus, the image transfer medium (ink ribbon) and the image receiving tape (substrate) are in the same cassette.

The present applicants have developed a different type of tape printing apparatus which is described for example in EP-A-578372. In this printing apparatus, the substrate tape is similar to that described in EP-A-267890 but is housed in its own tape holding case while the ink ribbon is similarly housed in its own tape holding case.

The known tape printing apparatus have input means, generally a keyboard, to allow the user to input an image to be printed. A display is normally also provided to display the input image or messages to the user. A cutting arrangement is provided to separate the image receiving tape on which an image has been printed from the supply of image receiving tape to thereby define a label.

In these known tape printing apparatus, the image receiving tape passes in overlap with the ink ribbon through a print zone consisting of a fixed print head and a platen against which the print head can be pressed to cause an image to transfer from the ink ribbon to the image receiving tape. This is usually done by thermal printing where the print head is heated and the heat causes ink from the ink ribbon to be transferred to the image receiving tape. This type of printing is known as thermal transfer printing. Alternatively, the print head may be in direct contact with a thermally sensitive image receiving tape whereby when the print head is heated, an image is printed directly on the image receiving tape. This type of printing is known as direct thermal printing.

In EP-A-798121, such a tape printing apparatus is disclosed, wherein the motor for driving the image receiving tape through the printing zone is located above the tape cassette, and below the upper casing of the housing. The tape cassette is thus inserted from the bottom side. The keyboard is situated on the upper part of the housing, at the lower end. The batteries are located besides the cassette, and below a part of the keyboard, at its lower end. It is alleged that this arrangement reduces the size of the printer, and obtains a weight balance. The housing of this printer is generally cubic, wherein the upper part of the housing is somewhat inclined. Consequently, this tape printing apparatus is not a hand-held type, since it is too thick, but a desk top device.

In U.S. Pat. No. 5,435,657, a tape printer is used in combination with a slot-in type cassette. The printhead is privotally fixed to the housing of the tool and interacts with a platen provided in the cassette. Since the printhead is spring biased towards the platen, it is capable of urging the cassette out of the printer, when the latches holding the cassette are released. The housing is approximately cubic, as well.

U.S. Pat. No. 3,823,808 describes another tape cassette, which is used in combination with a pocket calculator, which prints inputted and calculated data onto a tape in order to dispense with a display. A tape cassette is provided with a planar platen interacting with a printhead fixed to the housing of the printer. Further, a feed roller is provided on the cassette, interacting with a roller of the machine in order to drive the tape out of the cassette. In order to make the printed data more easily visible to the user, the tape in the cassette is bent for about 45° before printing. This device does not incorporate a display, but only a window through which the printed tape can be viewn.

EP-A-191495 refers to a desk-top thermal printer for printing labels provided on a label web. This printer comprises a housing with a brick-shaped bottom part incorporating a keyboard, wherein on its upper end an inclined portion is located, in which a display is provided. The printing mechanism is located in the upper part, behind the inclined portion. The batteries are located below the keyboard. The bottom part incorporates recessed protions for making it easier to hold the thermal printer in one hand while operating the keys of the keyboard with the other.

U.S. Pat. No. 5,626,428 discloses a tape printer with a keyboard having staggered keys, and a generally brick shaped housing, wherein the upper surface on which the keys are located is inclined with respect to the lower surface of the housing. The cassette is inserted from the bottom side.

U.S. Pat. Nos. 5,344,248 and 4,830,525 disclose desk-top printers with a hinged keyboard.

In British patent application 9717933.7, a hand held tape printer is disclosed, which has a single housing with a slim bottom part and a thicker top part. The top part houses the printing mechanism and the tape cassette, while the bottom part incorporates the batteries and the keyboard.

Thus, a number of tape printing devices are known in the art. None of them is however easily usable as a handheld tool, but as well suited for desk operation. It is therefore an object of the present invention to provide a tape printing device which is ergonomic and can be comfortably used in a multiplicity of positions.

SUMMARY OF THE INVENTION

According to a first aspect of the present invention there is provided a tape printing device for hand held operation, having a housing with a first part and a second part wherein:

- the first part of the housing comprises a surface with a keyboard with keys for inputting desired characters to be printed onto an image receiving tape, the surface having a breadth which is larger than a thickness of the first part of the housing, preferably a multiple thereof;
- and the second part of the housing comprises a cassette receiving bay for accommodating a tape cassette holding a supply of the image receiving tape, the second part of the housing further enclosing a print mechanism arranged to print the desired characters onto the image receiving tape.

The invention thus proposes a tape printing device which consists of two parts. A first part contains a keyboard for defining characters to be printed onto a label, and a second part contains a tape cassette and the necessary print mechanism for printing an image onto the image receiving tape. Since the relatively large mechanical parts, as the print mechanism and the tape cassette are housed in the second part of the housing, the first part can be designed relatively slim. The thickness of the first part can be thus much smaller than its breadth. The breadth is hence measured over the lateral width of the keyboard, and the thickness is measured orthogonally thereto, ie. in the direction in which the keys are depressed. Consequently, the tape printing device can be used ergonomically in hand-held operation, but is suited for desk-top operation, as well.

The first part of the housing can also accomodate a space in which one or more batteries are accomodated. This has the advantage that the entire printing device is balanced, since the print mechanism and the cassette in the second part of the housing, and the batteries in the first part of the housing yield an equilibrium of torques, such that the device is ergonomic to handle.

For ergonomic reasons, it is further proposed that an angle is defined between the first part of the housing and the second part of the housing. In particular, the second part of the housing can be angled rearwards with respect to the surface of the first part of the housing in which the keyboard is located. The user can then hold the printing device in his or her palm, and depress the keys with his or her second hand whereby the device rests with the bottom face of the second part of the housing on the forefinger of the user. The angle between the first part of the housing and the second part of the housing is between 30 and 60°, preferably approximately 45°.

The cassette is preferably loaded from a top face of the second part of the housing.

Further, a display for displaying inputted characters can be provided, whereby it is proposed that the display is inclined with respect to the surface of the first part of the housing in which the keyboard is located, such that it is easily readable without disturbing reflections and gives a more pleasing viewing angle. The angle between the display and the surface is advantageously between 10° and 80°, preferably approximately 30°.

Further advantageous features of the invention are disclosed in the dependent claims.

For example, a printed circuitboard cooperating with keys of the keyboard can be provided in the first part of the housing, and a second (main) printed circuitboard can be provided within the second part of the housing, the main printed circuitboard holding a controller operable to control the print mechanism and the display. Since the essential electronic parts are contained in the second part of the housing, the first part with the keyboard can be designed quite slim and thus user friendly. When all electronic components are thus removed from the printed circuitboard in the first part of the housing, it allows the circuitboard to be much cheaper material thereby saving unit cost.

A baseplate holding a motor, a platen roller and a print head holder with a printhead can be provided in the second part of the housing. The baseplate can be mounted to the main printed circuitboard, thus yielding a compact arrangement.

In order to reduce the volume of the print mechanism further, it is proposed that a motor is connected to a platen roller for driving the image receiving tape by at least one, preferably two worm gears and corresponding worm wheels. It should be noted that such a drive mechanism can be used in any tape printing device, and is not restricted to the type of tape printing devices of the type claimed in claim 1.

According to a second aspect of the invention, there is provided a combination of a tape printing device and a tape cassette, wherein:

the tape printing device comprises a peel plunger, the tape cassette comprises a housing in which a supply of tape is provided, and a peel slot arranged for accomodation of the peel plunger is defined within a side wall of the housing, the tape comprises an adhesive covered image receiving layer and a backing layer, and a portion of the tape is located between the peel plunger and the peel slot, and the peel plunger is arranged to move the tape into the peel slot, characterized in that the longitudinal axis of the peel slot and the longitudinal axis of the tape enclose a non-perpendicular angle.

The second aspect of the invention thus addresses to the problem of peeling of tape, ie. the separation of the image receiving layer and the releasable backing layer. In the prior art (EP-A-0634273 or EP-A-0526213), the plunger and the longitudinal axis of the tape are arranged to include an angle of 90°. Thus, peeling is performed by bending the tape over its entire width. Since a predetermined force is required for releasing the backing tape from the adhesive image receiving layer, and this force is proportional to the area in which peeling is performed, it is desirable to reduce this area in order to reduce the required force, or to improve the peeling result at a certain, available force. This aspect of the invention thus proposes to have a non-perpendicular angle between the longitudinal axis of the peel plunger and the longitudinal axis of the tape (=feed direction). The angle can be between 30° and 60°, preferably 45°. Since the peeled area is reduced, the peeling result is improved.

For a better understanding of the present invention and as to how the same may be carried into effect, reference will now be made by way of example to the accompanying drawings in which:

BRIEF DESCRIPTION OF THE DRAWINGS

FIGS. 8*a* and 8*b*, show a cutter button;

FIG. 10, shows a label with a peeled edge;

Figure 1:
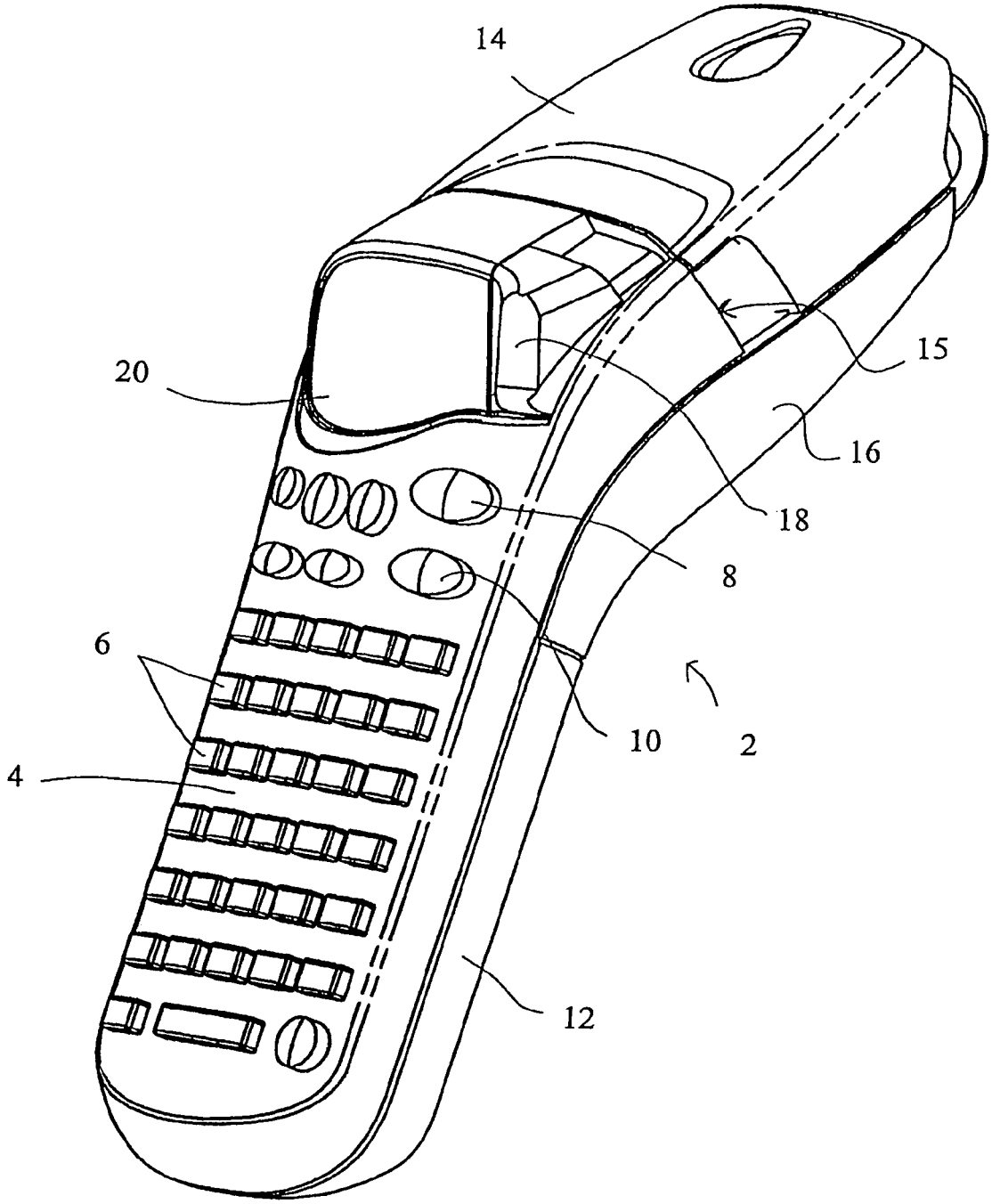
FIG. 1, is an isometric view of a tape printing device according to the invention.

A tape printing device according to the present invention is shown in a perspective view in FIG. 1 and generally annotated with reference numeral 2. The tape printing device 2 comprises a housing which is essentially composed of two parts, one first, lower part containing a keyboard and a second, upper part in which a printing mechanism and a tape cassette is located and covered by a lid 14. The housing of the tape printing device 2 is composed essentially of five parts of casework.

A first part of this casework is a keyboard casework 4, in which a number of alphanumeric keys 6 for composing a label to be printed onto an image receiving tape are located. The keyboard comprises further keys 8, 10, which are a print key and a shift key. In order to distinguish these function keys from the alphanumeric keys 6, they are located at the upper end of the keyboard, and have a shape and possibly colour different from the alphanumeric keys 6. Some further functional keys are located left of the print key 8 and shift key 10, and are depressed by a user when it is desired to activate a key cap function, or a mode/shift function, or to move the cursor over the display. The design and functionality of the keys as such can be as described in our co-pending British patent application GB 9806717.6. At the upper side of the keyboard casework, above the keys 6, 8, 10, a display cover 20 is housed within the keyboard casework 4. The display cover 20 is inclined with respect to the part of the surface of the keyboard casework 4 in which the keys 6, 8, 10 are located; the angle between display cover 20 (and a display inside the cover 20) and this surface is about 70°. This angle allows the user to hold the lower part of the tape printing device 2 with the keyboard in one of his hands and to view the display inside the protective cover 20 easily, without disturbing reflections.

A second part of the casework is a battery cover 12 located on the opposite side of the housing with respect to the keys 6, 8, 10 of the keyboard. This battery cover 12 can be opened (removed or pivoted) in order to exchang batteries, when necessary. The latter provide the tape printing device 2 with electric power, when operative. They keyboard casework 4 and the battery cover 12 thus constitute and enclose the first part of the housing of the tape printing device 2. Since only the keyboard (together with a corresponding printed circuit board) and the batteries are mounted within this first part of the housing, the first part is designed slim and is easy to handle, even for people with relatively small hands.

The second part of the housing of the tape printing device essentially contains a printing mechanism and a tape cassette as discussed below. A third part of the casework is thus a lid 14 which covers the printing mechanism which will be shown and described with reference to FIGS. 5–7. The lid is on its upper end (opposite to the display cover 20) pivotally mounted to a fourth part of the casework, which is a lower casework denoted with reference numeral 16. The lid 14 is located on the top side of the second part of the housing, such that a tape cassette is inserted from the top side, as well. The printing mechanism and the tape cassette are hence housed between the lid 14 and the lower casework 16, which both in combination constitute the second part of the housing of the tape printing device 2, together with a cassette bay casework (described later with reference to FIG. 6) for holding the tape cassette. This second part is arranged with a backwards inclination to include an angle of about 45° with the first, lower part of the housing of the tape printing device (containing the keyboard), whereby the first part and the second part of the housing are—when considered independently—generally of approximately cubic shape. This angled arrangement has ergonomic advantages, as well, since the bottom surface of the lower casework 16 can rest on the hand (particularly the forefinger) of a user when he or she holds the tape printing device 2 in his or her palm. Due to flat surfaces on the outer ends of the battery cover 12 and the lower casework 16, the device 2 can as well be placed onto a table for operation. It should be noted that the first part and the second part of the housing could be connected by means of a hinge or fulcrum, such that a foldable arrangement is obtained, yielding the advantage of a reduced storage space.

On the right side of the display cover 20, a cutter button 18 is located, which is depressed by a user when it is intended to cut a printed label off. The functionality of the cutter button 18 will be explained later with reference to FIGS. 8–11. Further, a tape exit 15 is provided within the right side wall of the housing, the exit 15 being defined by a gap between lid 14 and cassette bay casework. The tape emerges through the exit 15 after it has been printed. By depressing the cutter button 18, the user can cut off the printed label from the tape supply housed in the tape cassette.

Figure 2:
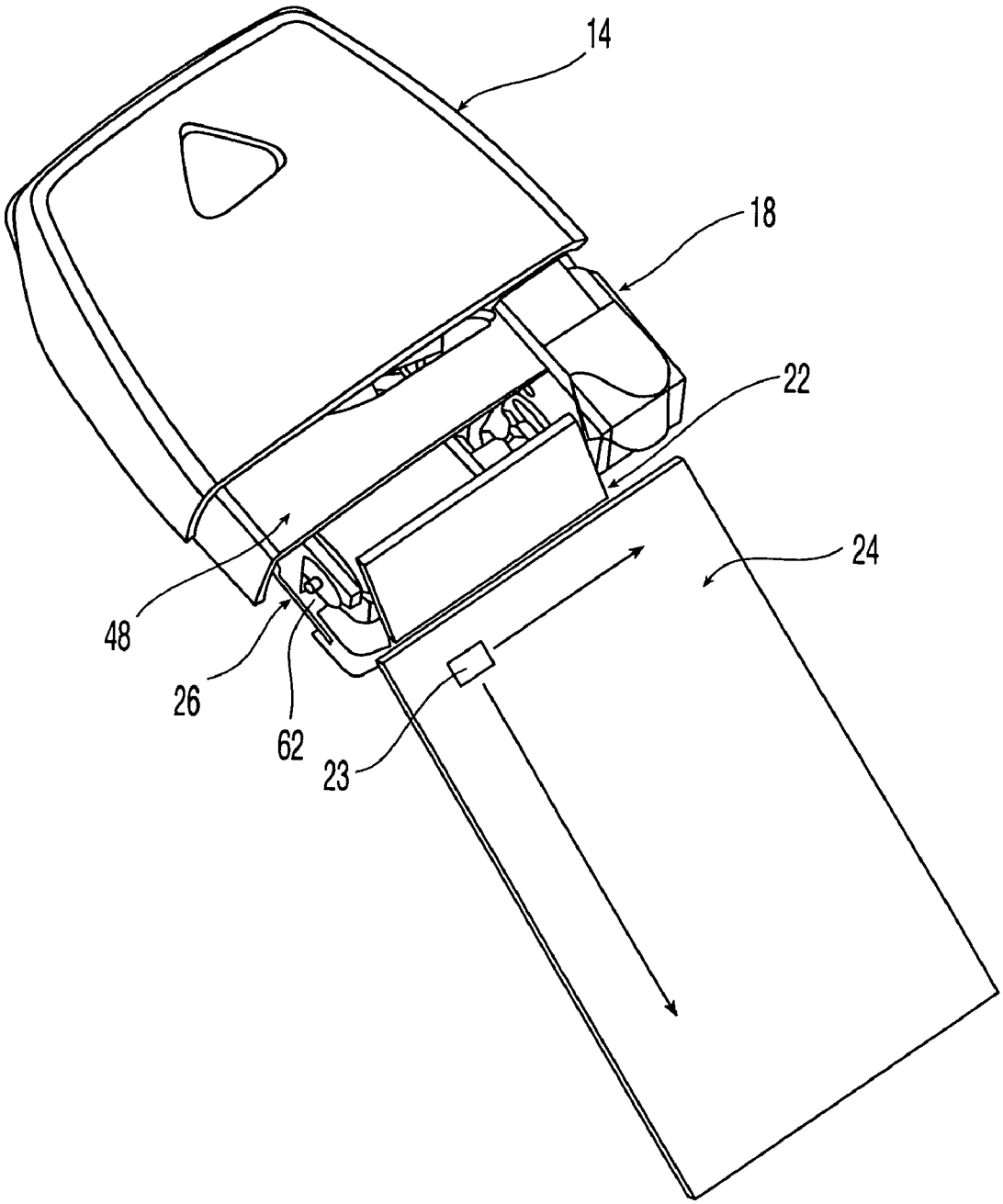
FIG. 2, shows the device of FIG. 1 with removed casework.
Figure 5:
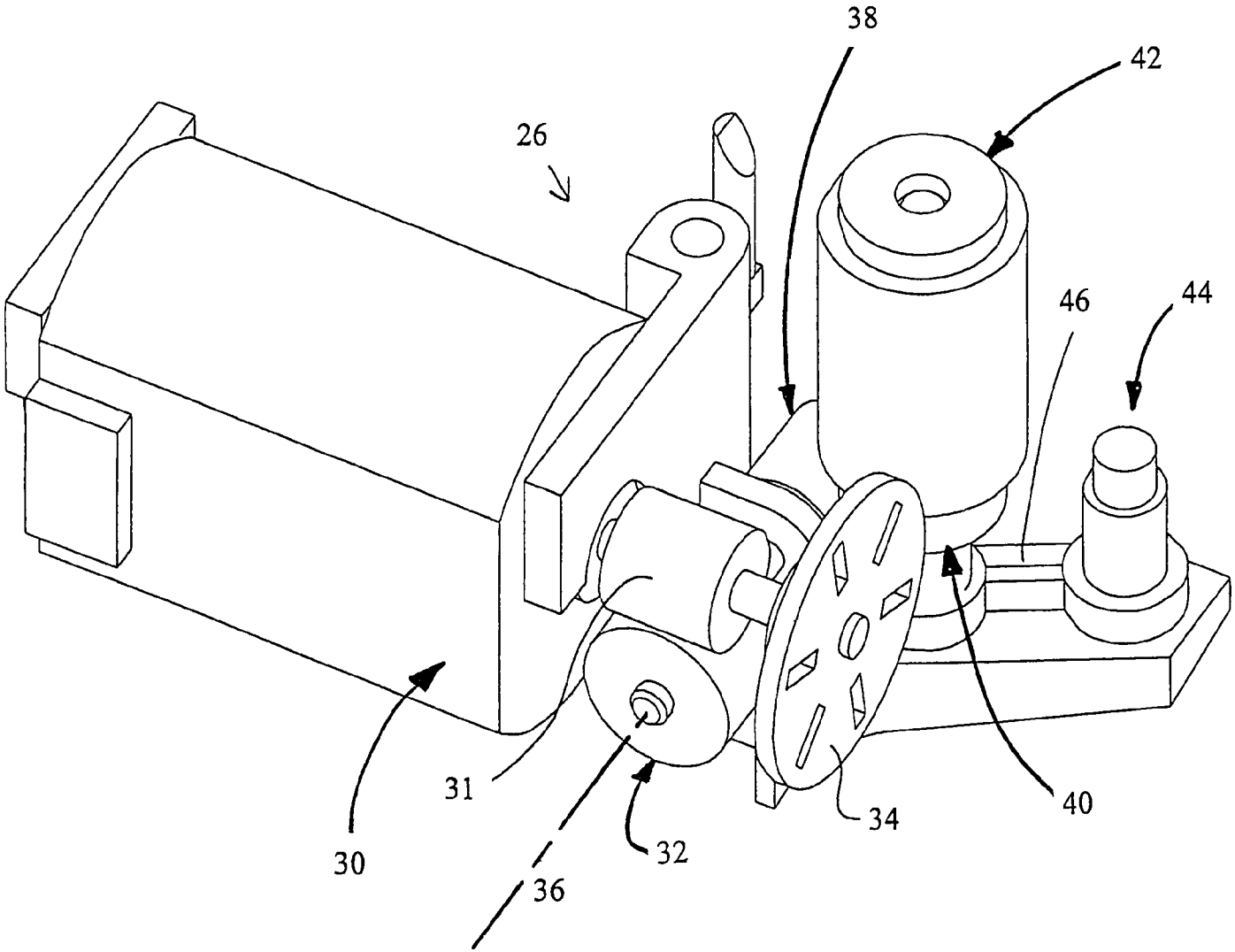
FIG. 5. shows a printing mechanism of the device.
Figure 7:
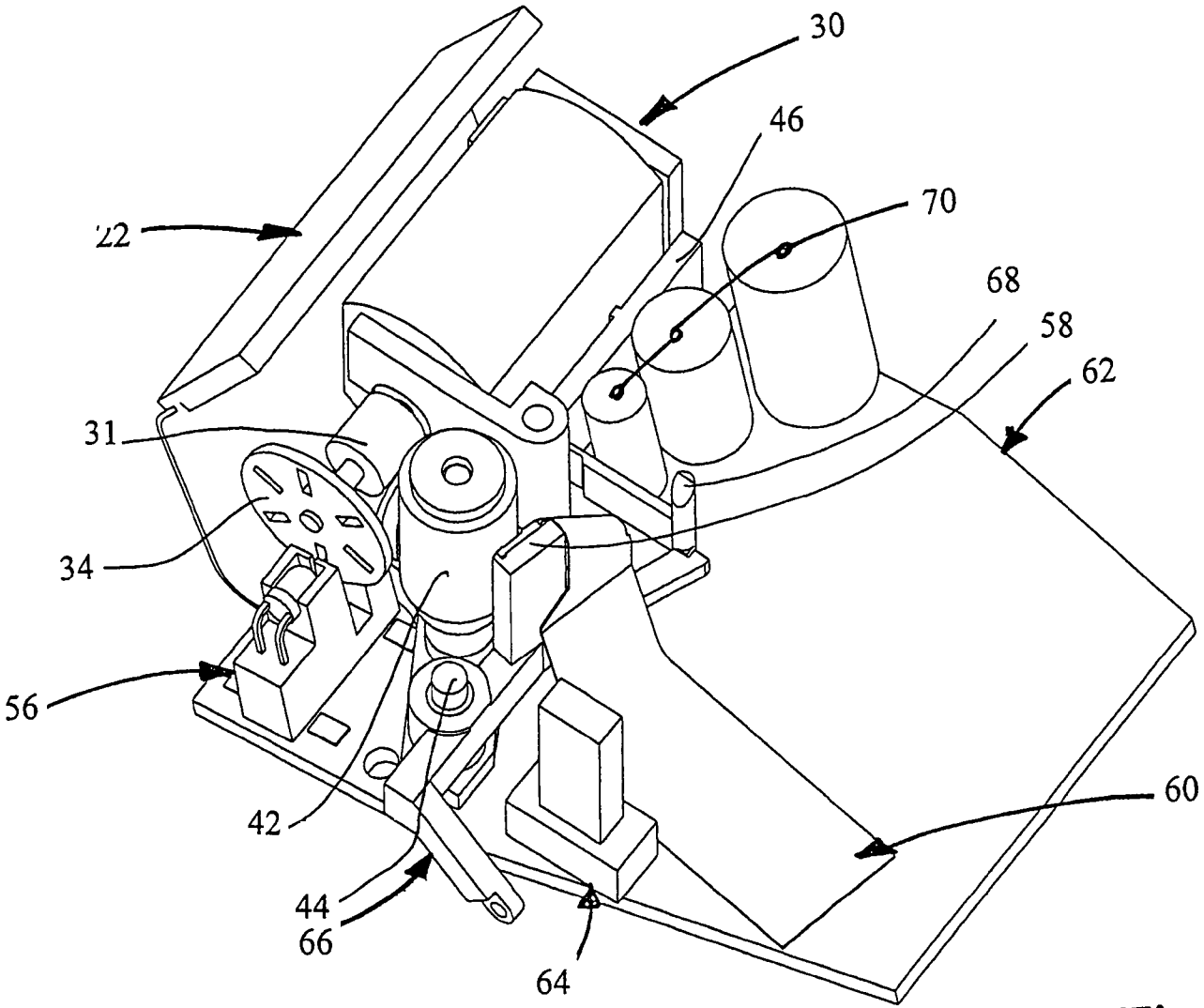
FIG. 7 shows the printing mechanism, with printhead.
Figure 16:
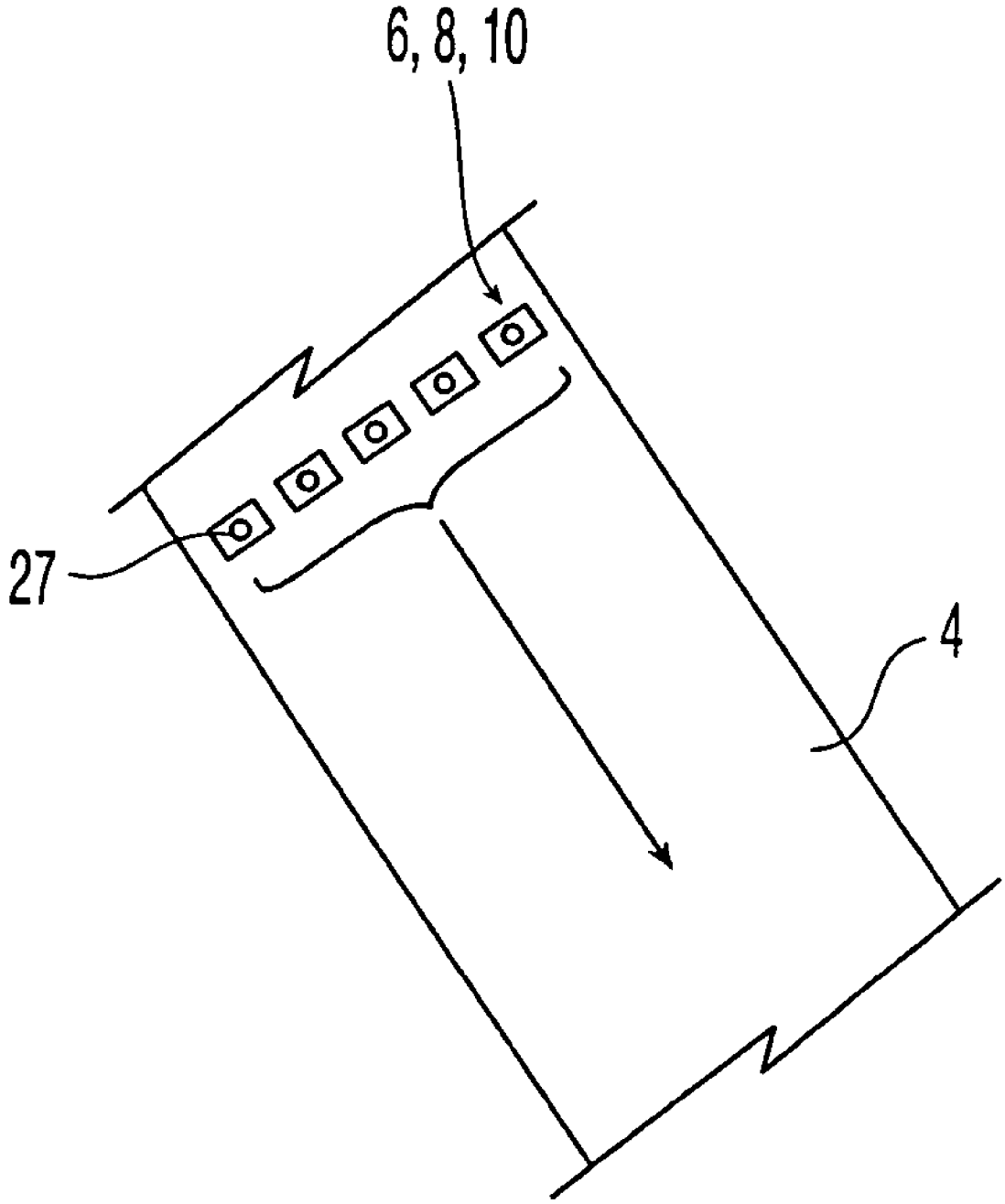
FIG. 16, is a plan view of the underside of the keyboard casework showing microswitches or carbon pills on the ends of the keys.

FIG. 2 gives a perspective view of the tape printing device of FIG. 1, whereby the keyboard casework 4, the battery cover 12 and the lower casework 16 are removed, in order to display the interior of the first part of the housing. This part essentially only houses a printed circuit board (PCB) 24 for the keyboard, and the keys 6, 8, 10 as such, which are removed in FIG. 2 for the sake of simplicity. The printed circuit board 24 is electrically connected to a main printed circuit board (main PCB) 62 within the second part of the housing. The main PCB 62 is further connected to a liquid crystal display 22, which is normally protected by (and visible through) the display cover 20. Parts of a print mechanism 26 are visible within the second part of the housing, however most of the print mechanism 26 is in FIG. 2 covered by the lid 14, but is shown in FIGS. 5 and 7. A cassette bay casework 48 is visible beneath the lid 14. This cassette bay casework 48 accommodates the tape cassette, and the cassette bay casework 48 and the lower casework 16 together form the hinge for the lid. Thus, the tape cassette is between the lid and cassette bay casework 48, and the print mechanism is mounted on the cassette bay casework 48 and between this lower casework 16. An advantage of the separate keyboard casework 4 is that only the casework 4, and possibly the keys 6, 8, 10 are specific for a designated country (in which a specific one of different sets of characters is required), while the entire remaining parts of the tape printing device are independent on the country-specific set of characters. It would thus be sufficient to have a stock of country-specific keyboard caseworks 4 and—when necessary—keys 6, 8, 10 (usually provided on a rubber keymat), which could be used to complete partially assembled tape printing devices 2 according to the number of orders from the respective countries. In this case, the microprocessor of the tape printing device controlling the print head and the display 22 would have to be instructed about the type of keyboard being used. This can be performed manually by solder links 23 (e.g. on the keyboard PCB. FIG. 2). microswitches 25 depressed by the keyboard casework 4 (a country-specific keyboard casework depresses specific microswitches), or by one or more carbon pills 27 depressed by a certain feature on the keyboard casework 4, arranged to close country-specific contacts, FIG. 16.

Figure 3:
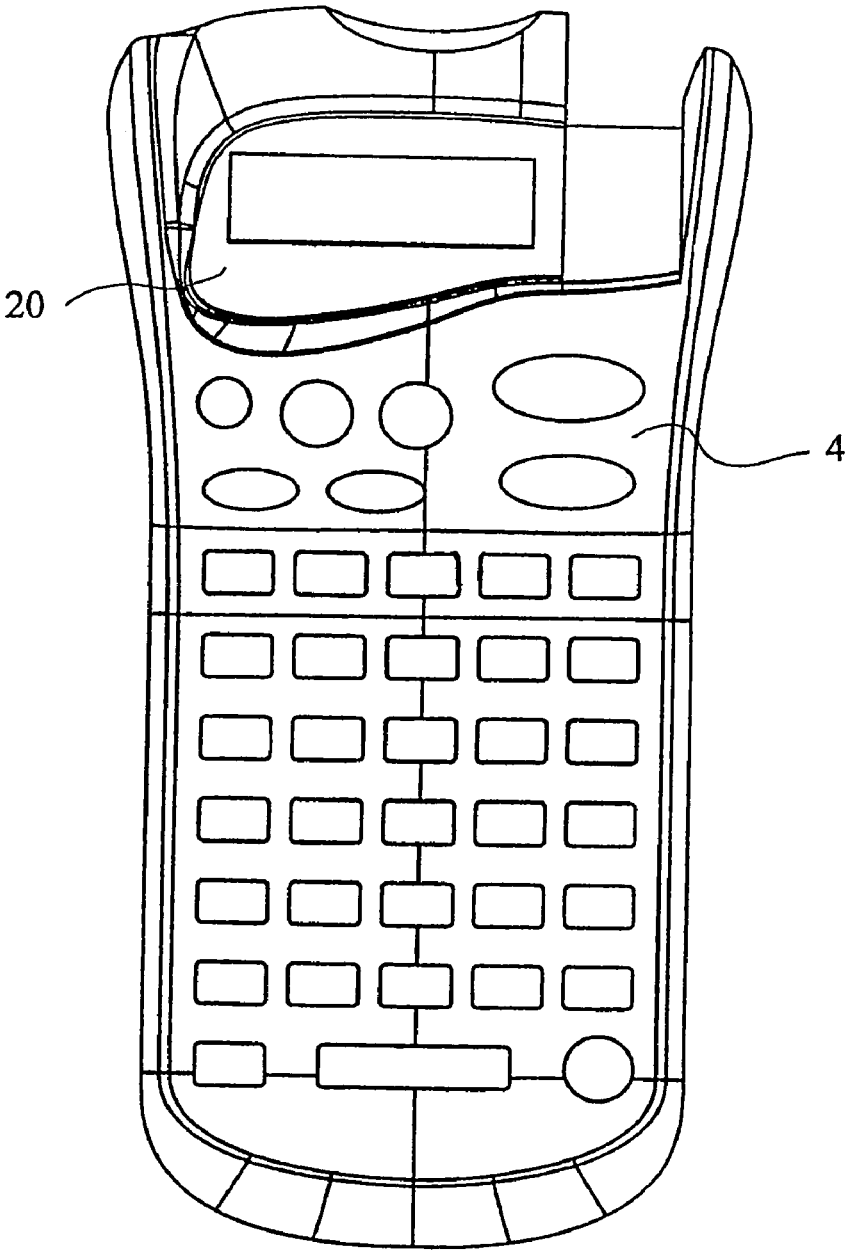
FIG. 3. shows a casework of the keyboard.

FIG. 3 is a perspective view of the keyboard casework 4, which comprises a number of holes in which the respective keys are located when the tape printing device is assembled. The display —over 20 is mounted at the upper end of the keyboard casework 4 and partially printed for design purposes, whereby a rectangular part in the center is left free, for maintaining the display 22 visible.

Figure 4:
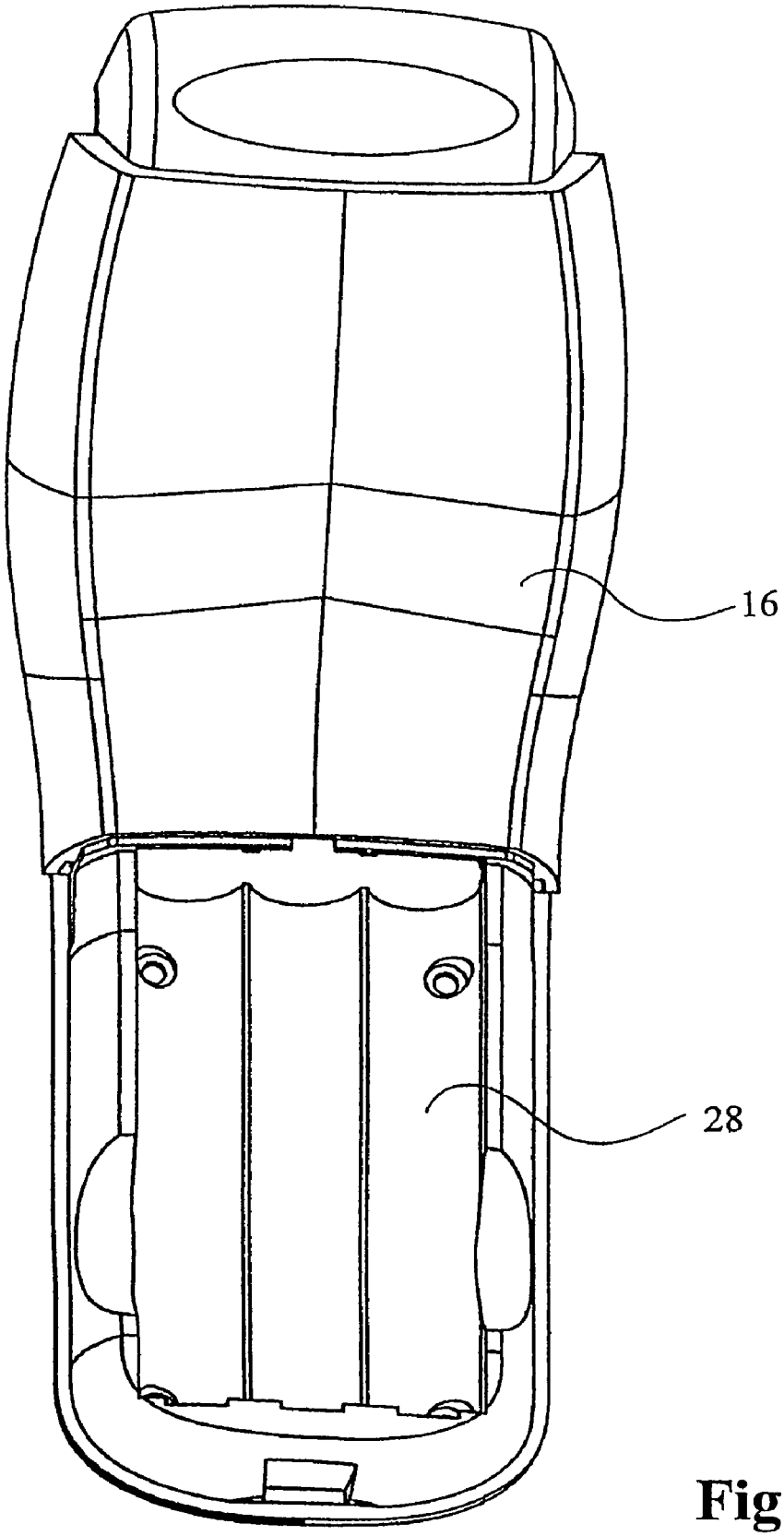
FIG. 4, shows a lower casework.

In FIG. 4, a perspective view from the bottom of the tape printing device 2 is shown. The battery cover 12 is removed, such that a battery housing 28 for accomodating batteries is revealed. The battery housing 28 is a moulded part of the lower casework 16. The battery cover 12 is retained by a clip at the lower end, and is slidable on the lower casework 16.

An isometric view of a part of the printing mechanism 26 is given in FIG. 5. The printing mechanism 26 comprises a baseplate 46 which is a unitary moulded plastics part. On the baseplate 46, a DC motor 30 is mounted. On the rotational axis of the motor, a first worm gear 31 is mounted, and an encoder disc 34. The purpose of the encoder disc will be described below. The first worm gear 31 drives a first worm wheel 32 which rotates around a drive shaft axis 36 enclosing an angle of 90° with the rotational axis of the motor, and drives a second worm gear 38. The second worm gear 38 is moulded onto a holder carrying a platen roller 42. Since the first worm wheel 32 and the second worm wheel 40 each comprise 14 teeth, a drive reduction ratio between motor 30 and platen roller 42 of 14·14=196 is obtained. An advantage of the worm gears is that a compact arrangement of the drive system is obtained. The baseplate 46 holds the DC motor 30, the drive shaft axis 36, the platen roller 42 (by means of a pin on which the roller 42 is mounted), and further comprises a printhead pin 44 for pivotally mounting a printhead holder. The baseplate 46 is provided with reinforcement ribs for enhancing mechanical stability.

Figure 6:
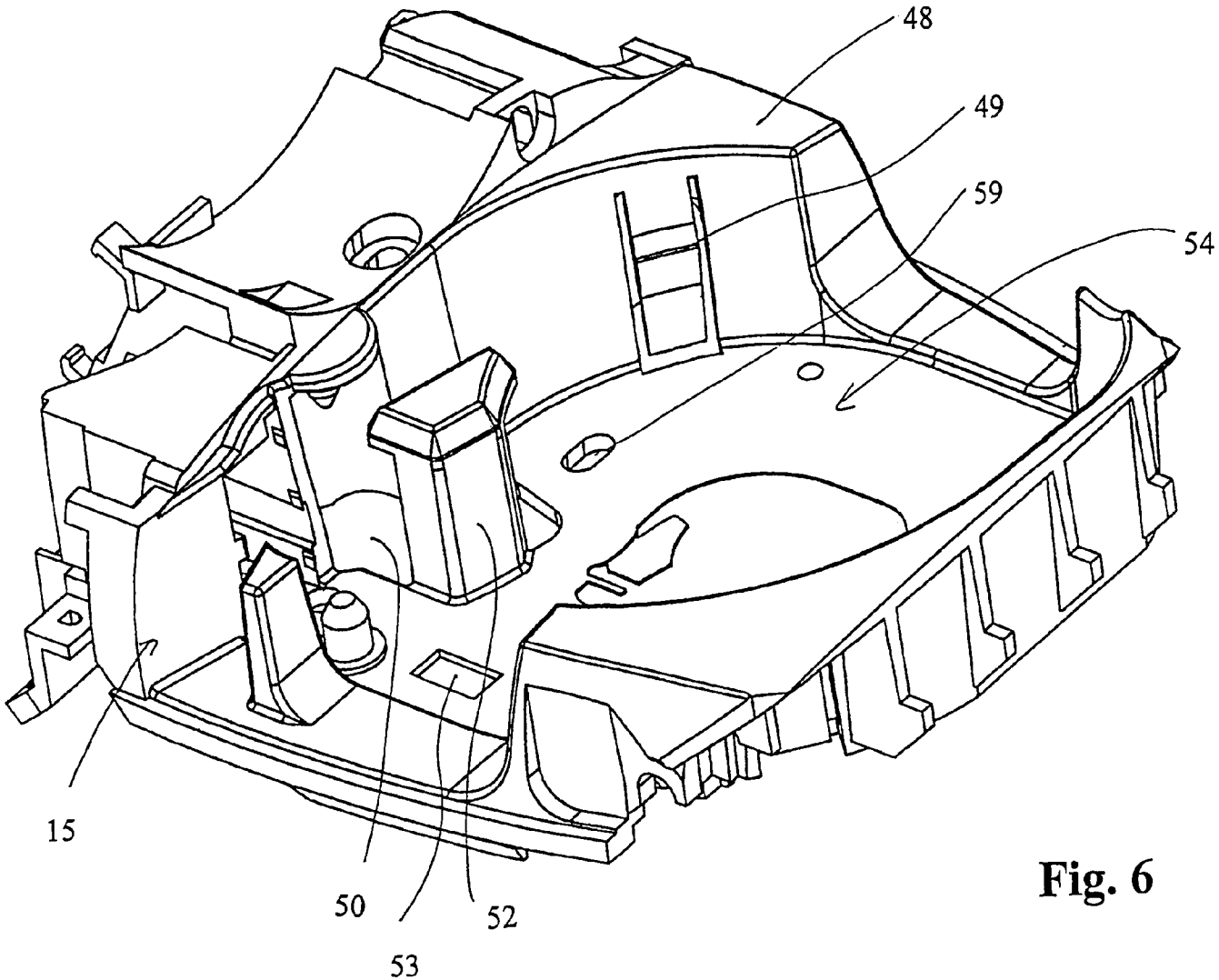
FIG. 6, shows a cassette bay casework.

In FIG. 6, an isometric view of a cassette bay casework 48 is given, which is in FIGS. 1 and 2 hidden by the lid 14. The cassette bay casework 48 forms in fact a fifth part of the casework of the housing of the tape printing device 2, and defines a cassette bay 54 in which a tape cassette (not shown) can be accommodated. In an assembled state, the cassette bay casework 48, is located below the lid 14 as shown in FIG. 1, wherein the tape exit 15 is located adjacent the lower front side of the cassette bay casework 48. The printing mechanism 26 mounted on the main PCB 62 is sandwiched between the cassette bay casework 48 and the lower casework 16. These three parts are fixed together, e.g., by means of screws or a snap-in connection. In the bottom of the cassette bay casework 48, a hole 50 is located through which the platen roller 42 protrudes, when the tape printing device is in the assembled state. Adjacent the hole 50, a protection cover 52 is provided, which extends over the print head (when assembled), in order to avoid user damage of the printhead when a cassette is inserted. A slot 53 is provided in the bottom of the cassette bay casework 48, through which a media type switch 64 protrudes (see FIG. 7). Another hole is denoted with reference numeral 59; it is for the cassette sensing pin 68 of FIG. 7 . Finally, the cassette bay casework 48 is provided with a retaining clip 49, for holding a tape cassette in position.

FIG. 7 represents the printing mechanism mounted to the main PCB 62. In particular, the baseplate 46 carrying the printing mechanism is fixed to the main PCB 62. As can be seen from the Figure, the printing mechanism comprises the motor 30, with the first worm gear 31 and the encoder disc 34 on its axis. The platen roller 42 is mounted to the baseplate 46, and driven by the motor 30 with the worm gears and worm wheels, as explained with respect to FIG. 5. Additionally, a printhead holder 66 is located on the printhead pin 44, and mounted for pivoting motion. A printhead 58 is fixed on the printhead holder 66, such that it can be moved towards the platen roller 42 for printing. When operative, an image receiving tape is located between the platen roller 42 and the printhead 58 with the sensitive side towards the printhead, and the printhead is urged against the tape. Since the platen roller 42 is driven by the motor 30, tape is during a printing operation fed from the printing location towards the tape exit 15, and the printhead is electrically activated such that its heating elements print the desired image under control of a microprocessor onto the image receiving tape, which is in the described embodiment of the present invention a direct thermal printing tape. It would be possible to design the tape printing device to accommodate a tape for thermal transfer printing, as well, this would however involve a capstan for the ink ribbon rewind. The printhead holder 66 carrying the printhead 58 is pivotally mounted such that it can be pivoted between an operative position in which the image receiving tape is clamped between the printhead 58 and the platen roller 42, and an inoperative position; which allows for changing the cassette holding the image receiving tape. This pivoting movement is coupled with the lid 14, as will be explained later with respect to FIGS. 12–15. In particular, when the lid 14 is opened, the printhead 58 is brought into the inoperative position leaving a gap between printhead 58 and platen roller 42, allowing for exchange of the tape. When the lid 14 is closed, the printhead 58 is moved towards the platen roller 42, but can only get in contact with the latter when a tape cassette is inserted. Thus, a cassette sensing pin 68 is provided which blocks the pivoting movement of the printhead holder 66 when no cassette is inserted. When however a cassette is inserted, the cassette sensing pin 68 is shifted out of the range of movement of the printhead holder 66, such that the printhead 58 can reach its operative position in which it is urged against the platen roller. Such a mechanism is described in more detail in published international application. WO-A 97/32731. The printhead 58 is connected to a controller circuit (usually microprocessor, not shown) on the main PCB 62 by means of a flexible cable 60. In order to control the speed of the DC motor 30, and to synchronize the strobe pulses sent to the printhead 58, a light barrier 56 is provided interacting with the encoder disc 34. This is performed as described in European Patent, EP-A-0 741044. On the main PCB 62, a number of capacitors 70 are mounted; and the LCD 22 is connected to the main PCB, as well. It should be noted that the cassette bay casework 48 as shown in FIG. 6 fits over the printing mechanism shown in FIG. 7, whereby the platen roller 42 protrudes through hole 50, and the cassette sensing pin 68 through the hole 59, such that they project into the cassette bay 54 for interacting with a tape cassette. A slide switch 64 mounted on the main PCB 62 protrudes through the slot 53 in the bottom of the cassette bay 54. This slide switch interacts with special features of the tape cassette and identifies the type of the image receiving tape, in order to adjust the printhead energy (strobe time or number of strobe pulses). The concept of the slide switch and interacting cassette is explained more detailed in European Patent EP-A-0634274.

The cutting mechanism implemented for cutting off a length of image receiving tape from the tape supply is illustrated in FIGS. 8*a* and 8*b*. FIG. 8*a* shows a bottom view of the cutter button 18, and FIG. 8*b* a side view. The cutter button 18 is provided with two upstanding blade guidance pins 74 which enter corresponding guidances in a tape cassette (see FIG. 9) during a cutting operation. A blade mounting face 72 is provided between the pins 74; when the cutter button 18 is entirely assembled, a cutting blade (not shown) with an angled cutting blade is mounted on the blade mounting face 72. This cutting blade is operable to perform a guillotine cut. The cutter button 18 is further provided with a diagonally mounted peel plunger 76 downstream of the cutting blade mounting face 72. The functionality of this plunger 76 will be explained with reference to FIGS. 9–11. The cutter button 18 is mounted in the keyboard casework 4 such that the cutter button of FIG. 8*b* is actuated in the direction indicated by arrow A, against the action of a spring.

Figure 9:
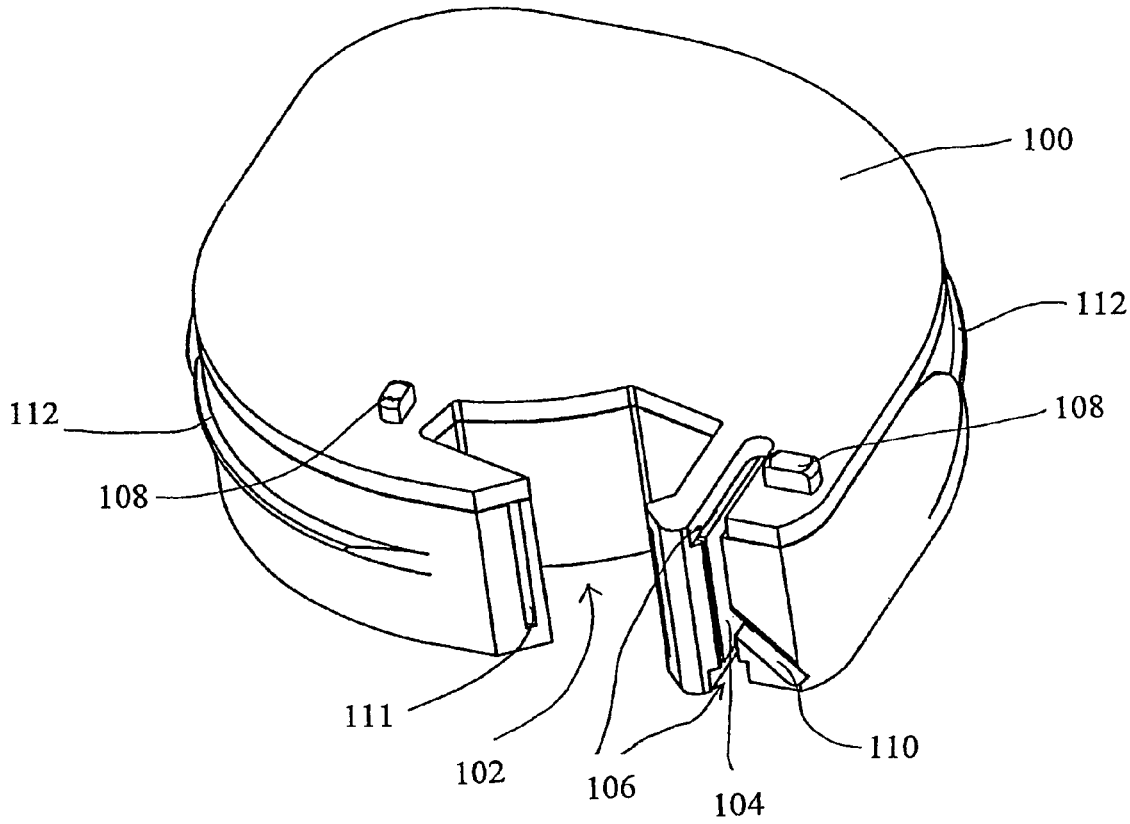
FIG. 9, is an isometric view of a tape cassette for use in the device.

An isometric view of a tape cassette 100 for use in the tape printing device 2 is shown in FIG. 9. An image receiving tape is contained therein, which is a direct thermal printing tape. An exit 111 is provided through which the front end of the tape leaves the cassette 100. Adjacent the exit 111, a recess 102 for accommodating the pivotally mounted printhead 58 is provided, as described in European Patent, EP-A-0555942. Downstream of the printing location defined by printhead 58 and platen roller 42, the cutting zone is located, wherein the cutting blade mounted to the cutter button 18 is arranged to cut off a printed portion of image receiving tape. This cutter blade is arranged to travel during cutting into a slot 104 defined in the side wall of the cassette 100, as described in European Patent. EP-A-0634275. The two blade guidance pins 74 mounted to the cutter button 18 travel at the same time into corresponding guidances 106 arranged at both ends of the slot 104, as described in our copending European patent application 97118104-5. These guidances thus allow an improved alignment of cutting blade and slot 104. An important feature of the cassette 100 is a peel slot 110, which encloses an angle of about 45° with the longitudinal axis of the tape, as the peel plunger 76 of the cutter button 18. Thus, the peel plunger 76 travels into the peel slot during the cutting operation, in order to peel a backing layer of the image receiving tape off the image receiving layer. This will be explained with reference to FIGS. 10 and 11. The cassette 100 is on its top surface further provided with small upstanding retention features 108, which are approximately cubic. The bottom surface of the cassette 100 has corresponding recesses for accommodating retention features 108 of a second cassette, such that two cassettes 100 can be mounted (clipped) together and at a later time released (unclipped). This concept is described in our copending application PCT/EP97/05065. On the side wall of the cassette 100, laterally overstanding retaining edges 112 are provided which interact with the retaining clips 49 in the cassette bay casework 48. Thus, the retaining edges 112 are depressed by the retaining clips 49 towards the bottom of the cassette bay 54, and the cassette 100 is held in the appropriate position for printing.

FIG. 10 illustrates the functionality of the cutting and peeling mechanism. It shows a portion of label tape 80 which has been cut off from the tape supply at a cut edge 82. The tape comprises as it is known in the art an image receiving layer, which is in the described embodiment a thermal sensitive layer (direct thermal printing layer), and a releasable backing layer which is secured to the image receiving layer by means of an adhesive. Once the non-adhesive backing layer has been removed from the image receiving layer, the latter can be stuck with its adhesive side onto an article to be labeled. A problem associated with tape printing devices in the state of the art is the separation of the backing layer and the image receiving layer. In the described embodiment, a peeling operation is performed by means of the peel plunger 76 and the corresponding peel slot 110 in the tape cassette 100. Since the plunger 76 and the slot 110 are arranged diagonally, a comer 84 of the tape 80 adjacent the cut edge 82 has been peeled, i.e., the backing layer is separated from the image receiving layer. The user can then grasp the part of the backing layer which has been peeled of, and remove the backing layer entirely from the image receiving layer. The angle of the peel plunger 76 of about 45° with respect to the longitudinal axis of the tape 80 improves performance in comparison with prior art devices (as disclosed e.g., in European Patents, EP-A-0526213 or EP-A-0634273), in which this angle is 90°, since a reduced area (about 25%) of the label is peeled for the same length of peel compared with the prior art. Further, the peel starts at a point (the lower right comer in FIG. 10) and is propagated towards the dotted line.

Figure 11A:
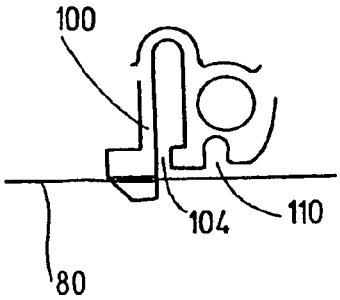
FIG. 11, illustrates the functionality of the peeling mechanism.
Figure 11B:
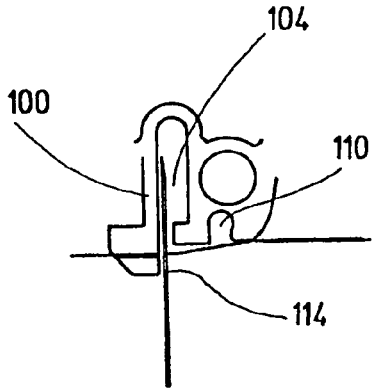
Figure 11C:
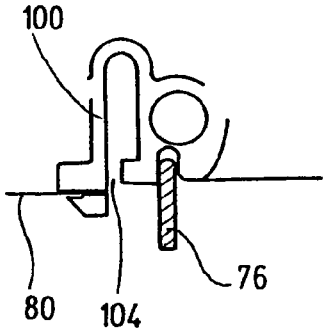
Figure 11D:
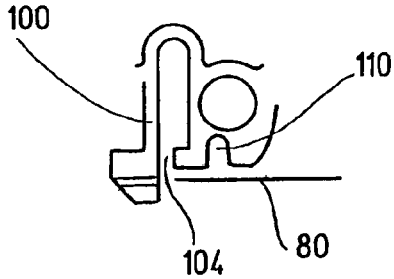

FIGS. 11*a* to 11*d* illustrate a horizontal section through the cutting mechanism during a cutting and peeling sequence obtained when the cutter button 18 is being depressed. In FIG. 11*a,* printed tape 80 is located at the cutting position, ie. adjacent the cutting slot 104 and the peel slot 110. In FIG. 11*b*, a blade 114 mounted to the blade mounting face 72 of the cutter button 18 cuts through the tape 80 and moves then into the cutting slot 104. Since the blade 114 projects more from the cutter button 18 than the peel plunger 76, the latter does not yet interact with the tape 80. When the cutter button 18 is now depressed further, the situation illustrated in FIG. 11*c* is obtained. Here, the cutter blade (although not shown) protrudes even deeper into the slot 104, and the peel plunger 76 presses the tape 80 adjacent the cut edge 82 into the peel slot 110. Thus, a bend is formed in the tape 80, such that the image receiving layer and the backing layer tend to separate. The peel plunger 76 does not necessarily have to protrude that far into the peel slot 110 such that the tape 80 is clamped between the plunger 76 and the bottom of the slot 110; it is sufficient when a gap larger than the tape thickness remains between plunger 76 and the bottom of the peeling slot 110. In FIG. 11*d*, the cutting blade 114 and the peel plunger 76 are retracted from the cassette 100, and the cut off portion of the tape can be torn out of the exit 15 of the tape printing device 2 by the user, thus obtaining a label as disclosed in FIG. 10. It should be noted that a brake (not shown) can be provided, which presses the tape 80 against a part of the side wall of the cassette 100 downstream the peel slot 110. This brake avoids misalignment of tape 80 and cutting blade 114 respectively peel plunger 76 during the cutting and peeling operation.

Figure 12:
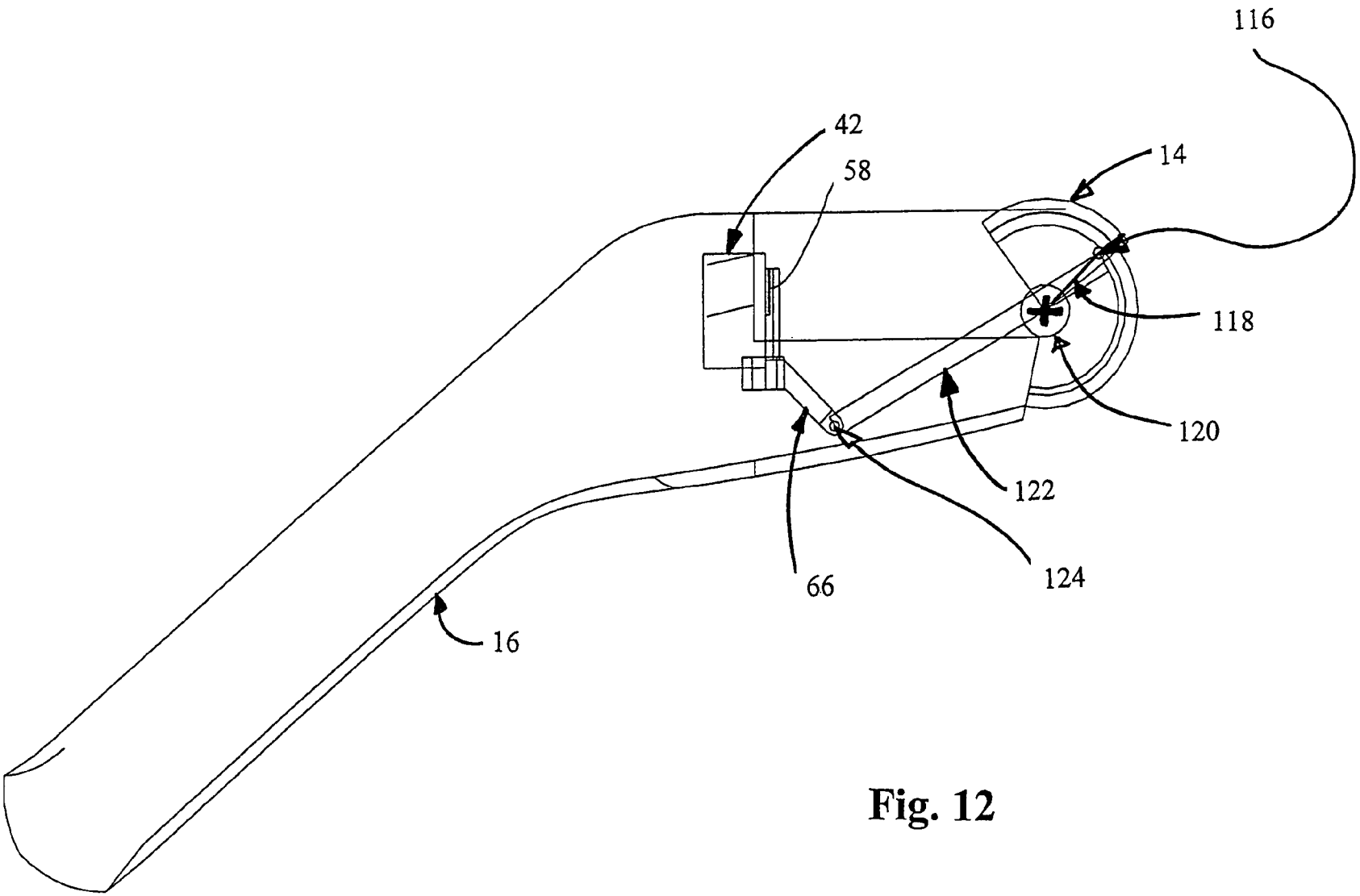
FIG. 12, is a section through the device of FIG. 1.
Figure 13:
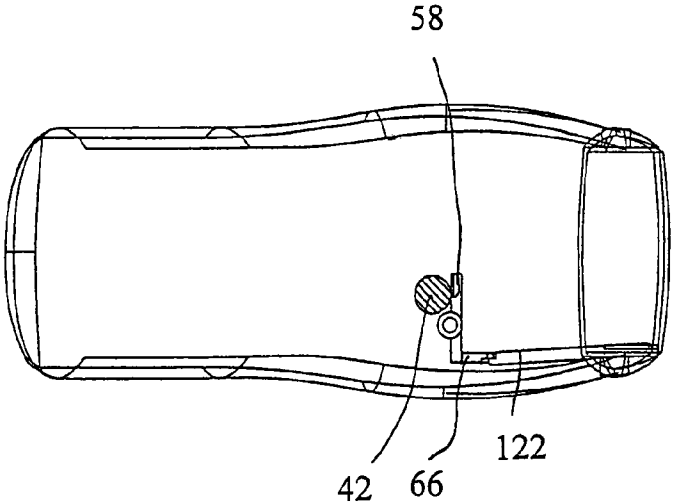
FIG. 13, is a second section through the device of FIG. 1.

FIGS. 12–15 illustrate the functionality of the connection between lid 14 and moving printhead 58. The lid 14 is pivotally mounted such that it rotates around a lid hinge axis 120 extending horizontally, and orthogonally to the plane of the drawing in FIG. 12. At the rear (right in FIG. 12) end of the lid 14, an actuation lever mounting point 116 is provided, at which an actuation lever 118 is mounted for pivotally motion together with the lid 14. On this actuation lever, a first end of a spring 122 is mounted. The second end of the spring 122 is connected to the printhead holder 66. Thus, when the lid is closed as indicated in FIG. 12, the spring is in a fully extended state and urges the printhead 58 against the platen roller 42 (when a cassette 100 is inserted into the cassette bay 54). This is illustrated in FIG. 13 showing a horizontal section through the tape printing device 2, as well. Printhead holder 66, actuation lever 118, lid hinge axis 120, spring 22 and pin 124 together define an over-center mechanism.

Figure 14:
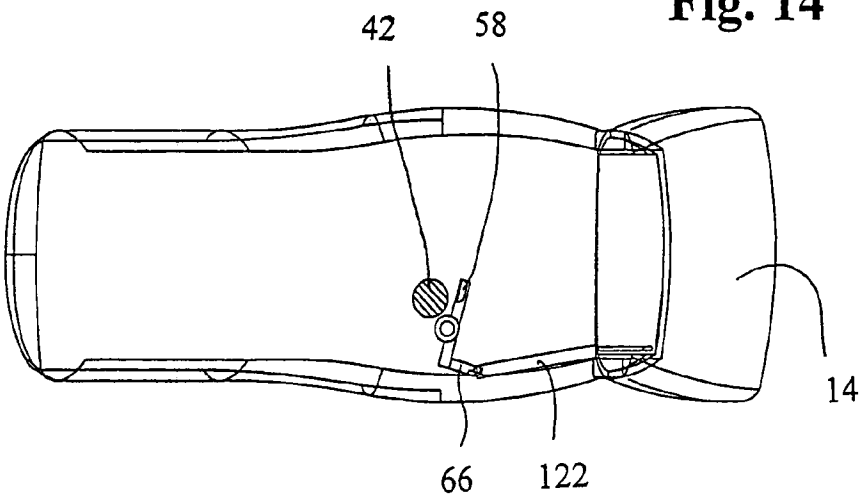
FIG. 14, is the section of FIG. 13, but with the lid opened.
Figure 15:
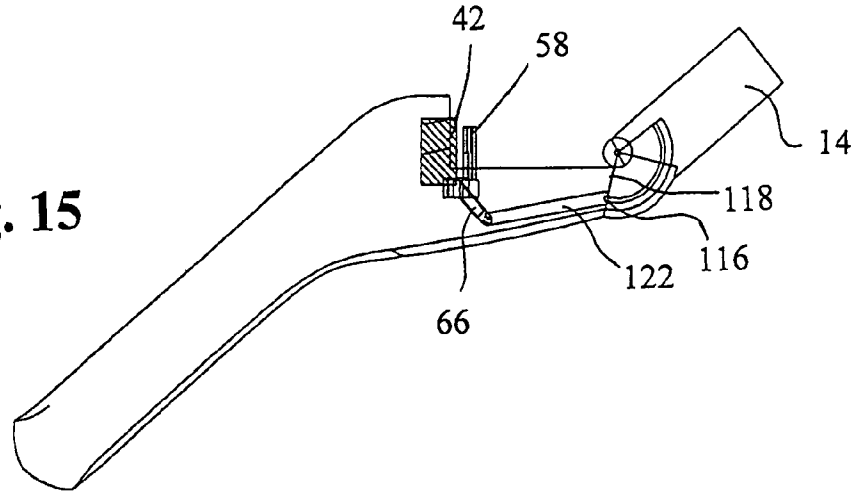
FIG. 15 is the section of FIG. 12, with the lid opened.

In FIGS. 14 and 15, the lid 14 is in its opened state. The user can thus exchange the tape cassette 100, since a gap is provided between the printhead 58 and the platen roller 42. Due to the position of the actuating lever 118, the spring 122 is now compressed, and the printhead 58 is released from the platen roller 42. It should be noted that the actuating lever mounting point 116 travels during the opening (and closing) motion of the lid 14 over centre; this means that the spring is in a first part of the motion further extended (more than in the lid closed position), and after the point in which the mounting point 116 is at the most rearwards position is passed, the spring gets compressed during the second part of the lid opening motion. Thus, the spring 122 holds the lid 14 in its open respectively closed position, as well, further to providing the appropriate pressure to the print head 58 in the operative position.

LIST OF REFERENCES

2 tape printing device
4 keyboard casework
6 keys
8 print key
10 shift key
12 battery cover
14 lid
15 tape exit
16 lower casework
18 cutter button
20 display cover
22 LC display
24 keyboard PCB
26 print mechanism
28 battery housing
30 motor
31 first worm gear
32 first worm wheel
34 encoder disc
36 drive shaft axis
38 second worm gear
40 second worm wheel
42 platen roller
44 printhead pin
46 baseplate
48 cassette bay casework
49 retaining clip
50 hole for accomodating platen
52 protection cover for print head
53 slot in cassette bay casework for media type slide switch
54 cassette bay
56 light barrier for encoder
58 printhead
59 hole
60 flexible printhead cable
62 main PCB
64 media type slide switch
66 printhead holder
68 cassette sensing pin
70 capacitors
72 blade mounting face
74 blade guidance pin
76 peel plunger
80 label tape
82 cut edge
84 corner peel
100 cassette
102 recess for accomodating print head
104 cutting slot
106 guidance for pin
108 retention features
110 peel slot
111 exit
112 retaining edge
114 blade
116 actuation lever mounting point
118 actuation lever
120 lid hinge axis
122 spring
124 print head holder mounting point of spring

What is claimed is:

1. A tape printing device for hand-held operation, the tape printing device accommodating a tape cassette having an image receiving tape therein, comprising:

a single housing having a first part and a second part, said first part having a first surface with a keyboard with keys for inputting desired characters to be printed onto the image receiving tape, said first part lying substantially along a first plane, said first part having a display for displaying input characters, said second part having a cassette receiving bay for accommodating the tape cassette, and a print mechanism for printing desired characters onto the image receiving tape, said second part lying substantially along a second plane, wherein said first and second parts are angled with respect to one another to thereby form a substantially V-shaped housing;

wherein said second part defines a top face, and wherein said cassette receiving bay is accessible from said top face;

wherein said second part comprises a lower casework located on a bottom face of said second part; and further comprising a main printed circuit board, wherein said main printed circuit board is located above said lower casework

2. The tape printing device of claim 1, wherein said first part comprises a keyboard casework in which said first surface is located.

3. A tape printing device for hand-held operation, the tape printing device accommodating a tape cassette having an image receiving tape therein, comprising:

a single housing having a first part and a second part, said first part comprising a first surface with a keyboard with keys for inputting desired characters to be printed onto the image receiving tape, a display for displaying input characters, and a keyboard casework, said first part lying substantially along a first plane;

said second part comprising a cassette receiving bay for accommodating the tape cassette, a print mechanism for printing desired characters onto the image receiving tape, a lower casework located on a bottom face of said second part, wherein said second part defines a top face, wherein said cassette receiving bay is accessible from said top face, said second part lying substantially along a second plane;

wherein said first and second parts are angled with respect to one another to thereby form a substantially V-shaped housing, and wherein said lower casework is fixed to said keyboard casework;

the tape printing device further comprising:

a cutter actuating button movably mounted to said keyboard casework; and a cutting blade, wherein said cutter actuating button is connected with said cutting blade and arranged to cut a portion of the image receiving tape.

4. The tape printing device of claim 3, wherein said first part comprises a breath and a thickness, wherein said breadth of said first part is greater than said thickness of said first part.

5. The tape printing device of claim 3, wherein said first part further comprises a housing part for accommodating a battery.

6. The tape printing device of claim 3, wherein the angle of said V-shape is between 30° and 60°.

7. The tape printing device as defined in claim 6, wherein said angle is 45°.

8. The tape printing device of claim 3, wherein a hinge or fulcrum is provided between said first part and said second part.

9. The tape printing device of claim 3, further comprising: a printed circuit board within said first part, said printed circuit board cooperating with the keys of said keyboard.

10. The tape printing device of claim 9, wherein said printed circuit board is provided with at least one of solder links, microswitches, or connections closeable by means of carbon pills, defining a country-specific character set.

11. The tape printing device of claim 9, wherein said printed circuit board is provided with means to select a country-specific character set.

12. The tape printing device of claim 3, further comprising: a main printed circuit board provided with said second part, said main printed circuit board including a controller circuit operable to control said print mechanism and said display.

13. The tape printing device of claim 3, further comprising: a baseplate holding: a motor; a platen roller; and a print head holder with a print head, all provided in said second part.

14. The tape printing device of claim 13, further comprising: a main printed circuit board, wherein said baseplate is mounted to said main printed circuit board.

15. The tape printing device of claim 13, wherein said baseplate comprises a unitary plastic molding.

16. The tape printing device of claim 13, further comprising: at least one worm gear and at least one worm wheel, wherein said motor is connected to said platen roller by said at least one worm gear and said at least one worm wheel.

17. The tape printing device of claim 16, wherein said motor is connected to said platen roller by two worm gears and two worm wheels.

18. The tape printing device of claim 3, further comprising: a pivotably mounted lid; a moving printhead; and an over-center mechanism, wherein said lid serves to close said cassette receiving bay and is connected to said moving printhead by means of said over-center mechanism.

19. The tape printing device of claim 3, further comprising: a battery cover; and a housing part for accommodating a battery, said housing part being in said first part, wherein said battery cover is releasably mounted to said keyboard casework and covers said housing part.

20. The tape printing device of claim 3, further comprising: a main printed circuit board, wherein said main printed circuit board is located above said lower casework.

21. The tape printing device of claim 3, and wherein said lower casework is fixed to said keyboard casework.

22. The tape printing device of claim 3, further comprising: a display cover, said display cover is mounted to said keyboard casework, and said display is visible through said display cover.

23. The tape printing device of claim 3, wherein the tape printing device is adapted for hand-held operation.

24. The tape printer of claim 3, wherein the first part defines a first lower surface, and the second part defines a second lower surface, wherein said first lower surface and said second lower surface are angled with respect to one another.

25. A tape printing device for hand-held operation, the tape printing device accommodating a tape cassette having an image receiving tape therein, comprising:

a single housing having a first part and a second part, said first part having a first surface with a keyboard with keys for inputting desired characters to be printed onto the image receiving tape and a display for displaying input characters, said first part lying substantially along a first plane;

said second part comprising a cassette receiving bay for accommodating the tape cassette, a print mechanism for printing desired characters onto the image receiving tape, and a lower casework located on a bottom face of said second part, wherein said second part defines a top face, wherein said cassette receiving bay is accessible from said top face, and wherein said second part comprises a cassette bay casework mounted to said lower casework, said cassette bay casework defining said cassette bay, and wherein said print mechanism is located between said cassette bay casework and said lower casework, said second part lying substantially along a second plane;

wherein said first and second parts are angled with respect to one another to thereby form a substantially V-shaped housing.

26. A tape printing device for hand-held operation, the tape printing device accommodating a tape cassette having an image receiving tape therein, comprising:

a single housing having a first part and a second part, said first part having a first surface with a keyboard with keys for inputting desired characters to be printed onto the image receiving tape, said first part lying substantially along a first plane, and said first part having a display for displaying input characters, said second part, a cassette receiving bay for accommodating the tape cassette, and a print mechanism for printing desired characters onto the image receiving tape, and said second part lying substantially along a second plane, wherein said first and second parts are angled with respect to one another to thereby form a substantially V-shape housing; and a cutter actuating button located adjacent said display and operable in a direction substantially parallel to said second plane.

27. A tape printing device for hand-held operation, the tape printing device accommodating a tape cassette having an image receiving tape therein, comprising:

a single housing having a first part and a second part, said first part having a first surface with a keyboard with keys for inputting desired characters to be printed onto the image receiving tape, said first part lying substantially along a first plane, said first part comprising a display for displaying input characters, and a keyboard casework;

said second part comprising a cassette receiving bay for accommodating the tape cassette, a print mechanism for printing desired characters onto the image receiving tape, and a lower casework located on a bottom face of said second part, said second part lying substantially along a second plane, wherein said first and second parts are angled with respect to one another to thereby form a substantially V-shaped housing, and wherein said lower casework is fixed to said keyboard casework, said tape printing device further comprising a cutter actuating button movably mounted to said keyboard casework; and a cutting blade, wherein said cutter actuating button is connected with said cutting blade and arranged to cut a portion of the image receiving tape.

* * * * *